US007337831B2

(12) United States Patent
Torii

(10) Patent No.: US 7,337,831 B2
(45) Date of Patent: Mar. 4, 2008

(54) HEAT TRANSFER DEVICE

(75) Inventor: Kahoru Torii, Yokohama (JP)

(73) Assignee: Yokohama TLO Company Ltd., Kanagawa (JP)

( * ) Notice: Subject to any disclaimer, the term of this patent is extended or adjusted under 35 U.S.C. 154(b) by 289 days.

(21) Appl. No.: 10/486,336

(22) PCT Filed: Aug. 9, 2002

(86) PCT No.: PCT/JP02/08185

§ 371 (c)(1),
(2), (4) Date: Feb. 10, 2004

(87) PCT Pub. No.: WO03/014649

PCT Pub. Date: Feb. 20, 2003

(65) Prior Publication Data

US 2004/0194936 A1 Oct. 7, 2004

(30) Foreign Application Priority Data

Aug. 10, 2001 (JP) ..... 2001-244000

(51) Int. Cl.
*F28F 13/12* (2006.01)
*F28D 1/053* (2006.01)

(52) U.S. Cl. ..... 165/109.1; 165/151; 165/181

(58) Field of Classification Search ..... 165/109.1, 165/151, 181
See application file for complete search history.

(56) References Cited

U.S. PATENT DOCUMENTS 1,743,861 A * 1/1930 Modine ..... 165/151
1,775,041 A * 9/1930 Karmazin ..... 165/151
1,853,315 A * 4/1932 Modine ..... 165/151
3,363,682 A * 1/1968 Hartley ..... 165/181
3,741,285 A * 6/1973 Kuethe ..... 165/181
3,916,989 A * 11/1975 Harada et al. ..... 165/151
4,984,626 A * 1/1991 Esformes et al. ..... 165/151
4,997,036 A * 3/1991 Schulze et al. ..... 165/182
5,361,828 A * 11/1994 Lee et al. ..... 165/109.1

(Continued)

FOREIGN PATENT DOCUMENTS

DE 496 733 4/1930

(Continued)

*Primary Examiner*—Leonard R Leo
(74) *Attorney, Agent, or Firm*—Jacobson Holman PLLC

(57) ABSTRACT

A separation wake zone behind a heat transfer tube in a heat transfer device of a heat exchanger or the like is reduced, whereby a heat transfer action of the heat transfer device can be augmented and a pressure loss thereof can be reduced. The heat transfer device of the heat exchanger has a linear or tubular heat transfer object (T) in heat transfer contact with a heat carrier fluid (A), and a heat transfer fin (F) integrally formed with the heat transfer object for heat transmission therebetween. The heat transfer fin is provided with a guide fin (10) positioned in vicinity of the heat transfer object, and the guide fin conducts the fluid to the rear of the heat transfer object, thereby reducing the separation wake zone behind the heat transfer object. A position (B) of separation point of the fluid is set to be at an angular position (β) equal to or greater than 90° from a stagnation point (E) on the heat transfer object by setting of an attack angle, configuration, position and dimensional proportion of the guide fin.

14 Claims, 10 Drawing Sheets

U.S. PATENT DOCUMENTS

| | | | | | |
|---|---|---|---|---|---|
| 5,697,432 | A | * | 12/1997 | Yun et al. | 165/151 |
| 6,079,487 | A | * | 6/2000 | Lopes et al. | 165/151 |
| 6,349,761 | B1 | * | 2/2002 | Liu et al. | 165/151 |
| 6,944,947 | B1 | * | 9/2005 | Damsohn et al. | 29/890.043 |

FOREIGN PATENT DOCUMENTS

| | | | | | |
|---|---|---|---|---|---|
| EP | 86559 | A2 | * | 8/1983 | 165/151 |
| GB | 2088544 | A | * | 6/1982 | 165/151 |
| JP | 55075190 | A | * | 6/1980 | 165/151 |
| JP | 55075191 | A | * | 6/1980 | 165/151 |
| JP | 58213192 | A | * | 12/1983 | 165/151 |
| JP | 60259894 | A | * | 12/1985 | 165/151 |
| JP | 61-110889 | | | 1/1986 | |
| JP | 61083893 | A | * | 4/1986 | 165/151 |
| JP | 61-6590 | | | 5/1986 | |
| JP | 61114091 | A | * | 5/1986 | 165/151 |
| JP | 69-161569 | | | 10/1986 | |
| JP | 61237995 | A | * | 10/1986 | 165/151 |
| JP | 62266391 | A | * | 11/1987 | 165/151 |
| JP | 63231198 | A | * | 9/1988 | 165/151 |
| JP | 63294494 | A | * | 12/1988 | |
| JP | 03075498 | A | * | 3/1991 | |
| JP | 07-217999 | | | 8/1995 | |
| JP | 08-291988 | | | 11/1996 | |
| JP | 09152288 | A | * | 6/1997 | |
| JP | 09159390 | A | * | 6/1997 | |
| JP | 11-118379 | | | 4/1999 | |

* cited by examiner (A)

(B)

I-I Section (A)

(B)

(A)

(C)

(B)

(D)

(A)

| | |
|---|---|
| B/H | 13.4 |
| L/H | 13.4 |
| D/H | 5.4 |
| $L_1$/D | 1.25 |
| D/B | 0.4 |
| $X_A$/H | 2.4 |
| $X_B$/H | 7.6 |
| $Y_A$/H | 1.2 |
| $Y_B$/H | 2.6 |
| h/H | 0.9 |
| $\gamma$ | 165° |
| l/D | 1.0 |

(B)

(C)

(D)

(A)

| | |
|---|---|
| B/H | 13.4 |
| L/H | 13.4 |
| D/H | 5.4 |
| $L_1$/D | 1.25 |
| D/B | 0.4 |
| $X_A$/H | 2.4 |
| $X_B$/H | 7.6 |
| $Y_A$/H | 1.2 |
| $Y_B$/H | 2.6 |
| h/H | 0.9 |
| $\gamma$ | 165° |
| l/D | 1.0 |

(A)

| | |
|---|---|
| B/H | 13.4 |
| L/H | 13.4 |
| D/H | 5.4 |
| $L_1$/D | 1.25 |
| D/B | 0.4 |
| $X_A$/H | 7.4 |
| $X_B$/H | 12.05 |
| $Y_A$/H | 3.75 |
| $Y_B$/H | 6.25 |
| h/H | 0.9 |
| $\gamma$ | 150° |
| l/D | 1/3 |

(A)

(B)

(C)

HEAT TRANSFER DEVICE

This is a nationalization of PCT/JP02/08185 filed Aug. 9, 2002 and published in Japanese.

TECHNICAL FIELD

The present invention relates to a heat transfer device, and more specifically, to such a device provided with a guide fin which acts as means for controlling a position of separation of a heat carrier fluid.

TECHNICAL BACKGROUND

In general, a heat exchanger for heating or cooling a fluid is provided with a heat transfer tube through which a thermal medium fluid to be heated or cooled is circulated, and the heat exchanger is so arranged that a heat carrier fluid, such as air, is forcedly moved around the tube. The thermal medium fluid in the tube is cooled or heated by heat exchange with the heat carrier fluid through a tube wall of the tube. In such a heat exchanger using gaseous fluid as the heat carrier fluid, a heat transfer performance depends on the thermal resistance of the heat carrier fluid, such as air, and therefore, fins in a variety of forms are attached to the tubes for increasing the heat transferable contact area between the tube and the heat carrier fluid and improving the heat transfer performance.

For instance, a high-fin-tube type of heat exchanger which has spiral metal fins attached to metal tubes and the tubes disposed in a staggered arrangement or an in-line arrangement, and a fin-tube type or plate-fin-and-tube type of heat exchanger, which is known as a kind of compact heat exchanger, are incorporated in thermal medium circuits of various power plants, thermal carrier circuits of air-conditioning systems, cooling water circuits of various internal combustion engines, and so forth.

The fin-tube type of heat exchanger cools the thermal medium fluid in the heat transfer tube by heat exchange between the fluid flowing through the tube and the gaseous flow moving in an area outside the tube. The fin increases the heat transferable area of the tube so as to improve the thermal efficiency of heat exchange between the gaseous flow outside the tube and the fluid inside the tube. In such a fin-tube type of heat exchanger, a heat exchanger formed with a number of dimples or slits is disclosed in Japanese patent laid-open publication No. 8-291988 and so forth.

However, even if the heat transfer effect can be designed to be doubled by improvement of configuration of the fin, the pressure loss in the heat exchanger is caused to greatly increase on the contrary, and it difficult to overcome such a problem. Therefore, it has been understood to be difficult to realize both of augmentation of heat transfer and reduction of pressure loss of heat carrier fluid by improving the configuration of the fin.

FIG. 10 is a partial cross-sectional view of a heat exchanger which is a conventional plate-fin-and-tube type of air-cooled heat exchanger.

With respect to heat transfer tubes T extending through fins F, an air flow A is compulsorily ventilated in a direction perpendicular to the tubes T, so that the air flow A passes through fluid passages P formed between the fins F. The air flow A separates from a boundary surface of the tube T at a separation point B, when flowing rearward along the outer surface of the tube T in the passage P between the fins F. The separation point B has been considered to reside at a position rearward from a stagnation point E by an angle β, which is approximately 80°. Because of such a separation phenomenon of the air flow A, the air flow A cannot sufficiently enter the rear of the tube T, and this results in creation of a separation wake zone C behind the tube T, which is called as "dead water zone". The separation wake zone C causes the heat transfer effect of heat exchanger to decline and the pressure loss thereof to increase.

It is a purpose of the present invention to provide a heat transfer device which can reduce the separation wake zone behind the heat transfer tube so as to improve the heat transfer effect of the heat transfer device in the heat exchanger and so forth, and which can reduce the pressure loss of the heat transfer device.

It is another purpose of the present invention to provide an air-cooled type of heat exchanger which can decrease a load of a fan for providing compulsory draft of the heat carrier fluid, thereby reducing noise of the heat exchanger during operation of the fan.

It is still another purpose of the present invention to provide a separation position control method for the heat transfer device which allows the position of separation point of the heat carrier fluid to be controlled with use of separation position control means having a simplified arrangement, thereby reducing the separation wake zone behind the tube.

DISCLOSURE OF THE INVENTION

Having preserved steady efforts to the study for achieving these purposes, the present inventor confirmed that the air flow A could enter the rear of the tube by displacing the position of the aforementioned separation point B to a range of the angle $\beta>90°$, whereby the separation wake zone C could be considerably reduced or eliminated. Thus, the present inventor attained this invention, based on such findings.

The present invention provides a heat transfer device having a linear or tubular heat transfer object which is in heat transfer contact with a heat carrier fluid, and a heat transfer fin which is integrally formed with the heat transfer object for heat transmission between the tube and the heat transfer object, comprising:

said heat transfer fin provided with a guide fin, which is positioned in vicinity of said heat transfer object and oriented at a predetermined attack angle with respect to said fluid so as to conduct the fluid to rear of said heat transfer object, thereby reducing a separation wake zone behind said heat transfer object.

According to the arrangement of the present invention, the heat carrier fluid (A) flows through a fluid passage formed between the guide fin (10) and the heat transfer object (T), while being in heat transfer contact with the object, guide fin and heat transfer fin. The guide fin is oriented to make a predetermined attack angle (α) with respect to the fluid, so that the fluid is conducted to the rear of the heat transfer object. The guide fin acts to reduce the separation wake zone (C) behind the tube, thereby augmenting the heat transfer of the device and also, reducing the pressure loss thereof. A part of the heat carrier fluid gets over or goes beyond the guide fin to generate a longitudinal vortex behind the guide fin. This longitudinal vortex effect causes a swirling flow to be generated in the rear of the guide fin, the swirling flow being deflected in accordance with the inclination of guide fin (the attack angle α). The swirling flow makes further improvement in the heat transfer effect of the heat transfer device without providing an excessive pressure loss in the heat transfer device.

The present invention also provides an air-cooled type of heat exchanger provided with a fan effecting compulsory draft of the heat carrier fluid and said heat transfer device as set forth above, whereby noise caused in operation of the fan is diminished by reduction of pressure loss of said heat transfer device. Since a blast capacity of heat carrier fluid required for ensuring a predetermined heat transfer effect is lowered by augmentation of the heat transfer of the device and reduction of the pressure loss thereof, the load of fan for compulsory draft is reduced. Therefore, it is possible to reduce the electricity consumption of fan and the noise in the air-cooled type of heat exchanger during operation of the fan.

The present invention further provides a method of controlling a position of separation in a heat transfer device which has a linear or tubular heat transfer object and a heat transfer fin integrally formed with the heat transfer object for heat transmission between the tube and the heat transfer object, a heat carrier fluid being passed through a fluid passage formed between the heat transfer fins, wherein a guide fin is disposed in vicinity of said heat transfer object and a position of a separation point of said fluid with respect to the heat transfer object is controlled to be in a range of angular position equal to or greater than 90° from a stagnation point (E) of the heat transfer object by setting of an attack angle, configuration, position and dimensional proportion of the guide fin.

According to this feature of the present invention, the position of separation point is determined by setting of the attack angle, configuration, position and dimensional proportion of the guide fin. The position of separation point is a principal factor on the basis of which a manner of creation of separation wake zone behind the heat transfer object is controlled, and the condition of the separation wake zone is one of essential factors on which the heat transfer performance and pressure loss of the heat transfer device or the heat exchanger are dependent. Therefore, in accordance with the method of the present invention, the position of separation point is controlled by setting of the guide fin so that the separation wake zone behind the heat transfer object is reduced, whereby both of the heat transfer performance and the pressure loss of the heat transfer device or the heat exchanger can be improved.

In a preferred embodiment of the present invention, an altitude (h) of the highest part of the guide fin is dimensionally set to be equal to or greater than one quarter (¼) of an interval (Pf) of the heat transfer fins, and the length (L) of base/the altitude (h) at the highest part of the guide fin is set to be in a range from 2 to 7 (2~7). Preferably, a rear end portion of the guide fin is set to be positioned at the angular position $\theta_2$ (the angle $\theta_2$ measured from the stagnation point E) which is in a range of from 80° to 176° (80°~176°), and the distance R' between the rear end portion and the center of the heat transfer object with respect to the radius R of the heat transfer object is set to be a ratio ranging from 1.05 to 2.6 (R'/R=1.05~2.6).

The guide fin may be provided on either side of the heat transfer fin so as to extend from one side to the other side, or it may be provided on both sides in a pair. In a case of provision of the guide fin on only one side, the altitude (h) at the highest part of guide fin is set to be, at least, one half of the interval (Pf) of the heat transfer fins. For example, the guide fin has a triangular configuration which includes a base on a plane of the heat transfer fin and an oblique line defining its upper edge, the upper edge inclining from a position of the gap toward the upstream side of the heat carrier fluid flow. The guide fin may have a trapezoidal, rectangular or arcuate configuration, or the like. Preferably, the guide fin is integrally formed on the heat transfer fin by cutting and elevating the heat transfer fin.

In a further preferred embodiment of the present invention, the aforementioned heat transfer object is a heat transfer tube (T) through which a thermal medium fluid to be heated or cooled can pass, and the heat transfer fins are arranged in a lengthwise direction of the tube, spaced a predetermined distance from each other. The thermal medium fluid is cooled or heated by heat exchange between the thermal medium fluid in the tube and the heat carrier fluid flowing in close vicinity of the surfaces of the tube and the heat transfer fin. The guide fins are positioned on both sides of the tube in symmetry so as to define fluid passages for the heat carrier fluid between the guide fins and the tube. The passage diverges toward the upstream side of the heat carrier fluid and converges toward an area downstream of the tube. The attack angle of the guide fin with respect to a direction of the heat carrier fluid flow is set to be a predetermined angle in a range from 5° to 60° (5°~60°) and the downstream end of the guide fin is spaced from the tube wall of the heat transfer tube so as to form a narrow gap for spouting the heat carrier fluid therethrough to the rear of the tube. According to such a heat transfer device, the heat carrier fluid flows through the fluid passage formed between the tube and the guide fin while being in heat transfer contact with the tube and the heat transfer fin. The contiguity is made in a direction of the heat carrier fluid flow by the guide fin and the tube, whereby the separation point of the heat carrier fluid is shifted to a position at an angle $\beta$>90° and the velocity of heat carrier fluid flow is accelerated so as to direct a spouting flow at a relatively high velocity through the aforesaid gap to the rear of the tube. The heat carrier fluid flowing into the rear of the tube prevents so-called "dead water zone" from being created behind the tube, and therefore, the separation wake zone is considerably reduced or substantially eliminated. Such reduction or elimination of the separation wake zone results in not only augmentation of heat transfer between the tube and the heat carrier fluid, but also reduction of pressure loss of the heat carrier fluid. In general, the pressure loss tends to significantly increase in use of a heat carrier fluid of a low Reynolds number, and therefore, the present invention exhibits especially significant effects of heat transfer augmentation and pressure loss reduction in its application to a heat exchanger with use of such a heat carrier fluid.

In the aforementioned method of controlling a position of separation, the guide fins are symmetrically disposed in a direction of span of the heat transfer objects, and the attack angle $\alpha$ of the guide fin relative to the direction of the heat carrier fluid flow is set to be a predetermined angle in a range of 5°~60°, preferably 10°~45°, more preferably 10°~30°. The attack angle, configuration, position and dimensional proportion of the guide fin are preferably so set as to generate a swirl flow behind the guide tube. The position of separation point ($\beta$) is preferably controlled to be an angular position equal to or greater than 100° from the stagnation point (E).

BEST MODE FOR CARRYING OUT THE INVENTION

A preferred embodiment of the heat exchanger according to the present invention is described in detail hereinafter.

Figure 1:
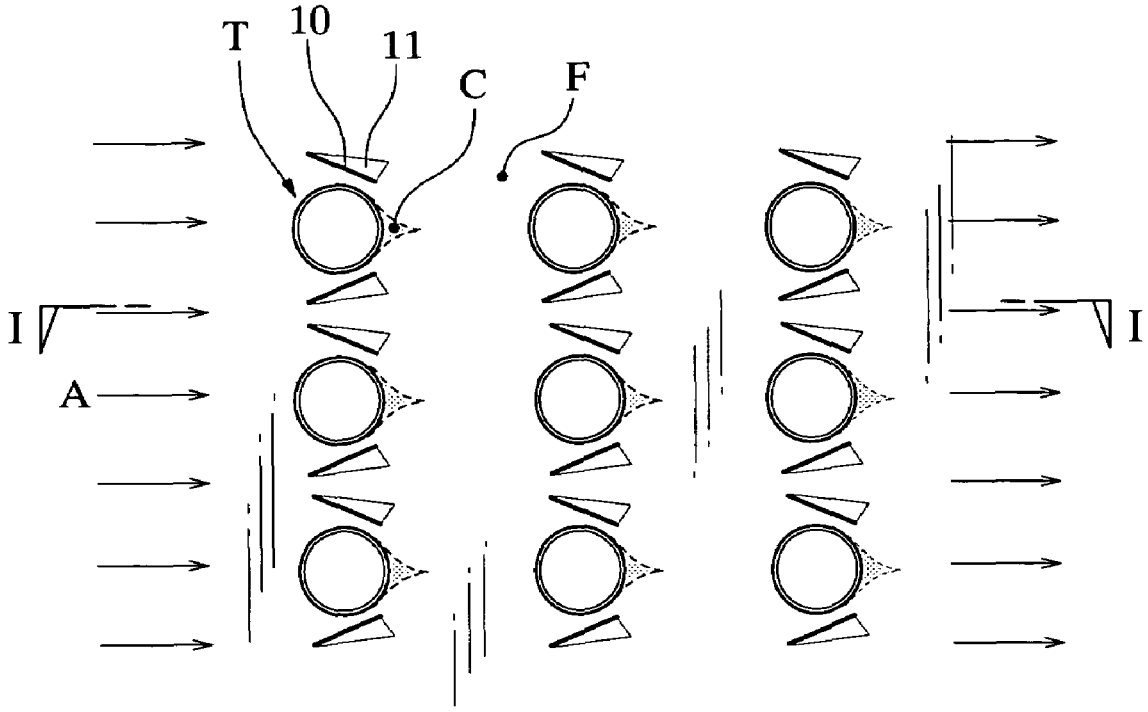
FIG. 1 is a cross-sectional view showing an embodiment of the plate-fin-and-tube type of heat exchanger provided with a guide fin according to the present invention.
Figure 1:
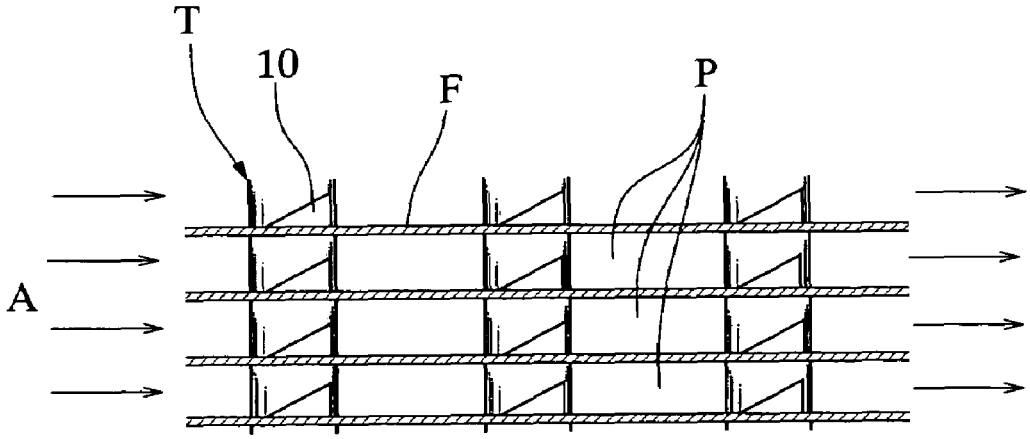
Figure 2:
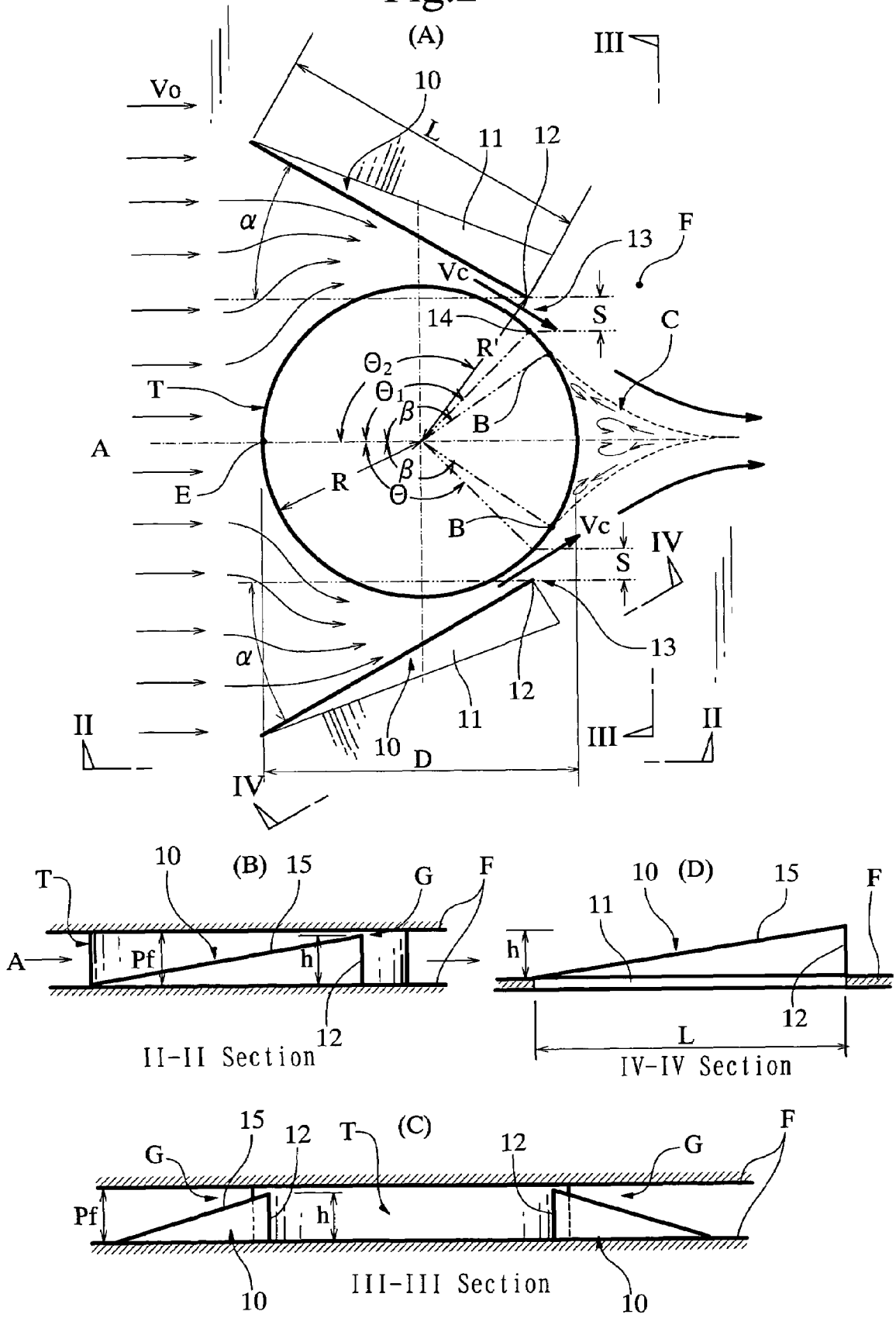
FIG. 2 is an enlarged cross-sectional view of the heat exchanger as shown in FIG. 1.

FIGS. 1 and 2 are cross-sectional views showing an embodiment of the plate-fin-and-tube type of heat exchanger.

The heat exchanger has a plurality of heat transfer tubes T spaced apart a predetermined distance from each other and arranged in rows, and a plurality of plate fins F arranged in an orientation perpendicular to the tubes T. The tube T and the fin F are made of the same sort of metal. The tube F constitutes a fluid passage for a thermal medium fluid having a circular cross-section, and the fins F on the tubes T are integrally attached to the tubes T for heat transmission between the fin and the tube, so that an extensive area of heat transferable plane surface is provided in the heat exchanger. Fluid passages P, through which a flow of cooling air A can pass, are defined between the fins F.

The thermal medium fluid at a relatively high temperature circulates through the tubes T and the cooling air flow A is forcedly drafted in a direction perpendicular to the tubes T. The air flow A blown through the heat exchanger moves on a boundary layer of the fins F and tubes T as a heat carrier fluid, so as to receive the heat by heat transfer contact with the fins F and tubes T, and then, the air is exhausted through a downstream exhaust port of the heat exchanger.

The heat exchanger of this embodiment is provided with guide fins 10 elevated from the fins F, which act as separation restriction means for restricting separation of the air flow A. The guide fin 10 is formed by locally cutting and elevating the fin F in a form of triangle. The fin F is formed with an opening 11 corresponding to an outline of the guide fin 10. The guide fins 10 are disposed in a pair on both sides of the tube T, and the fins 10 have the formation and layout symmetric with respect to a center axis of the tube T.

In FIG. 2, an arrangement and a layout of the guide fins 10 are illustrated more concretely.

Each of the guide fins 10 is obliquely oriented at an attack angle $\alpha$ with respect to a direction of the air flow A. A narrow gap 13 limited in its fluid passage area by the guide fin 10 is formed between an outer surface of the tube T and a rear end portion 12 of the fin 10. A close point 14 opposing against the end portion 12 in a direction perpendicular to the air flow A (a spanwise direction) is spaced a distance S from the end portion 12. The point 14 is positioned at an angle $\theta_1$ measured from a stagnation point E on the tube T. The end portion 12 is positioned at an angle $\theta_2$ (an angle $\theta_2$ measured from the stagnation point E) and a distance R' in a cylindrical coordinate of FIG. 2. Preferably, the angle $\theta_2$ is set to be in a range from 80° to 176°, and a ratio of the distance R'/a radius R of the heat transfer tube is set to be in a range from 1.05 to 2.6, wherein the distance R' is a distance between the end portion 12 and the center of the heat transfer tube.

The fin 10 has a configuration of right-angled triangle with its length of the base L and its altitude h. The opening 11 having a profile identical with that of the fin 10 is adjacent to the base of the fin 10 on its side opposite to the tube T. The altitude h (the height of the vertex) is set to be a dimension somewhat smaller than the interval Pf of the fins F (fin pitch). Preferably, the altitude h is set to be a dimension equal to or greater than one quarter of the fin pitch Pf, more preferably, at least one half thereof.

Operation of the aforementioned guide fin 10 is described hereinafter.

The air flow A enters the space between the tube T and the fin 10. The air flow A gradually accelerates while varying in its direction, as the width of the fluid passage between the fin 10 and the tube T reduces in accordance with the inclination of the fin 10, and the air flow A finally spouts rearward through the gap 13 at a velocity Vc. The flow spouting through the gap 13 is directed in an approximately tangential direction of the point 14.

The guide fin 10 allows the air flow A to be accelerated and stabilized, and also, the fin 10 conducts the air flow A in a direction along a surface of tube wall of the tube T to regulate the direction of spouting flow through the gap 13. The fin 10, which guides the air flow A, acts to restrict the separation phenomenon of the air flow A from the tube T, so that occurrence of the separation is retarded or delayed. As the result, a position of the separation point B is displaced considerably rearward, compared to a case where the guide fin F is not provided. The angular position $\beta$ of the separation point B with reference to the position of the stagnation point E has been observed to be approximately 80° in a conventional arrangement without provision of the guide fin 10, whereas the angular position $\beta$ is observed to be equal to or greater than 90°, e.g., 100°~135°, in the heat exchanger according to this embodiment. As the result of rearward displacement of the separation point B, the air flow A can smoothly flows to the rear of the tube T, and the pressure loss of the air flow A is reduced. Thus, the guide fin 10 acts as separation position control means for controlling the position of the separation point B, so that the separation point B can be controlled by the configuration and position of the guide fin 10.

Further, the altitude h of the guide fin 10 is set to be smaller than the fin pitch Pf, and therefore, a gap G is provided between an upper edge 15 of the fin 10 and the fin F. A part of the air flow A flows beyond the fin 10 to the rear thereof to cause a swirl motion, so that a longitudinal vortex is generated behind the fin 10. The fin 10 is oriented in the attack angle $\alpha$ relative to the air flow A and the gap G extends in an direction of the angle $\alpha$ with respect to the air flow A, and therefore, the longitudinal vortex flow is deflected by the fin 10 so as to somewhat get close to the tube T. An effective heat transfer augmentation, e.g., the heat transfer augmentation effect of 15%~50%, can be attained by generation of the longitudinal vortex, without an excessive increase of pressure loss being caused.

Figure 3:
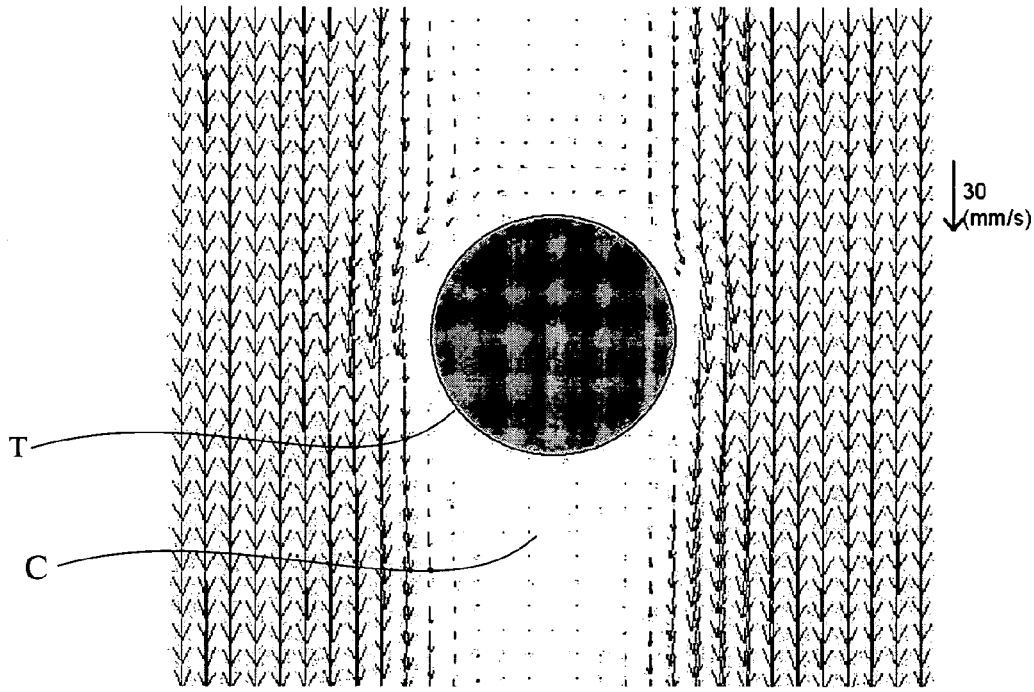
FIG. 3 is an enlarged cross-sectional view of the heat exchanger taken as an image of water flow which is a simulation of property of air flow, the property of air flow in the conventional heat exchanger without the guide fin being illustrated in FIG. 3(A) and the property of air flow in the heat exchanger with the guide fin being illustrated in FIG. 3(B)
Figure 3:
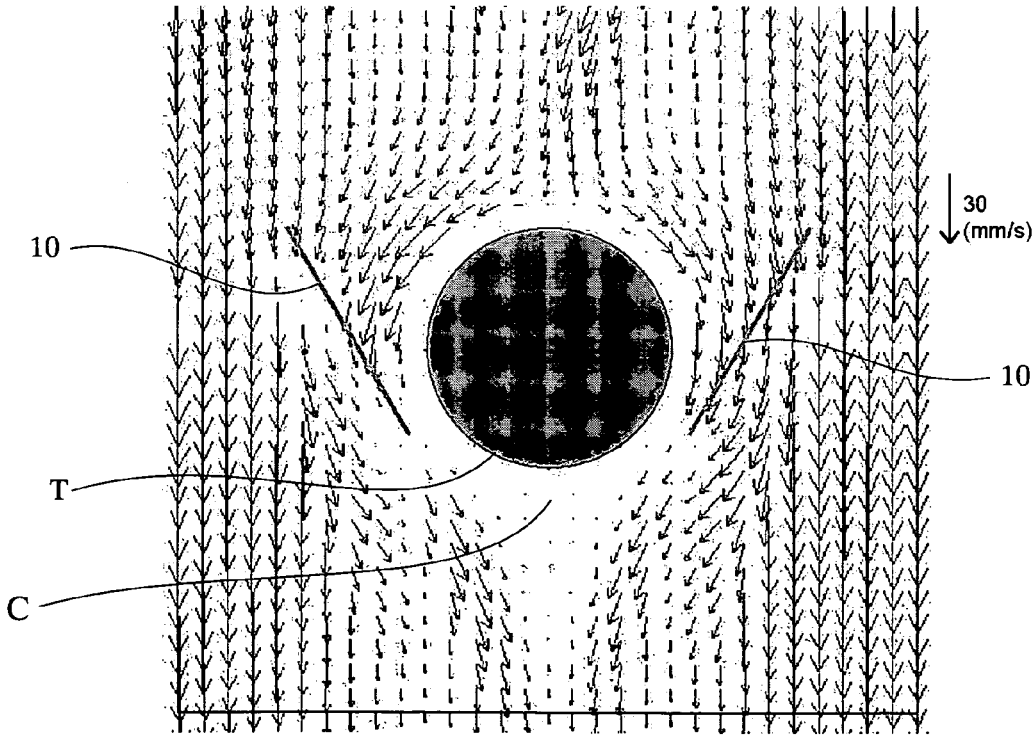

FIG. 3 shows a captured image of water flow, which is a simulation of property of the air flow A. The air flow property in a heat exchanger which does not have the guide fin 10 is illustrated in FIG. 3(A), and the air flow property in a heat exchanger which has the guide fin 10 is illustrated in FIG. 3(B).

The magnitude of each vector in FIG. 3 represents the velocity of air. As is apparent from comparison between FIG. 3(A) and FIG. 3(B), the dead water zone behind the tube is considerably reduced by provision of the guide fin 10.

Thus, the gap 13 directs toward the rear of the tube T, the spouting air flow having a relatively high velocity and deviated inward of the tube T. The spouting air flow dispels a major part of the deadwater zone of the tube T so that the separation wake zone C is reduced. This, in cooperation with effects of generation of the longitudinal vortex as set forth above, results in improvement of heat transfer performance of the heat exchanger and reduction of pressure loss of the air flow A.

Figure 4:
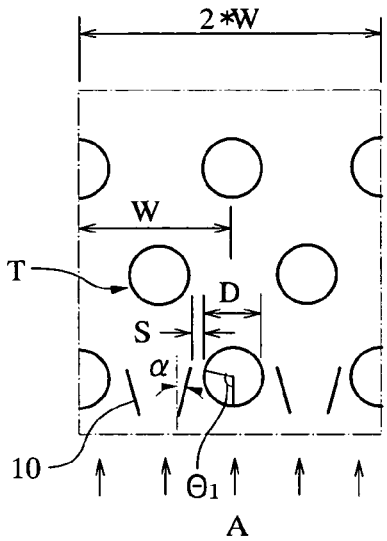
FIG. 4 is a graphic illustration showing results of experiments on augmentation of heat transfer and reduction of pressure loss in the heat exchanger provided with the guide fin.
Figure 4:
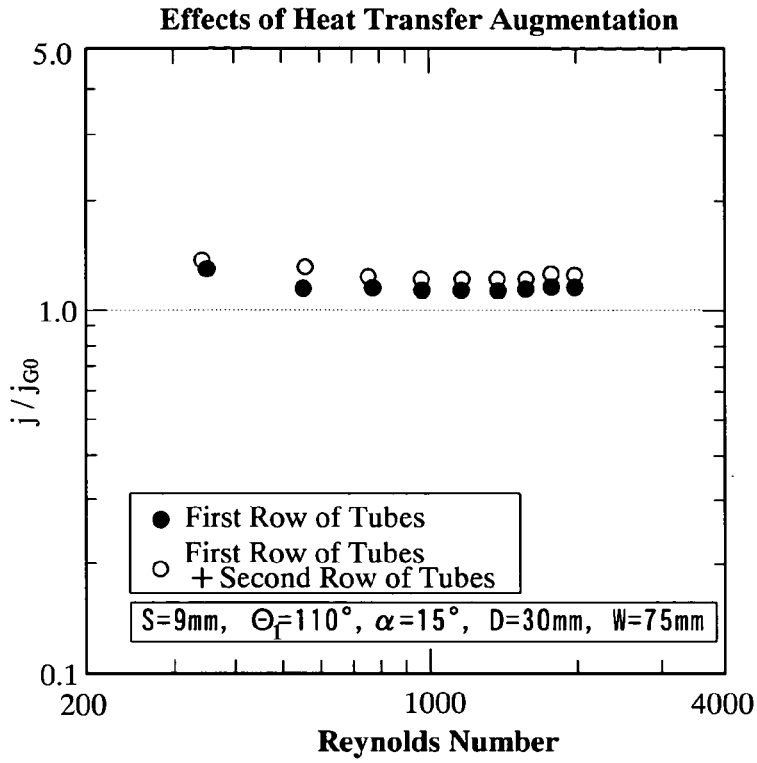
Figure 4:
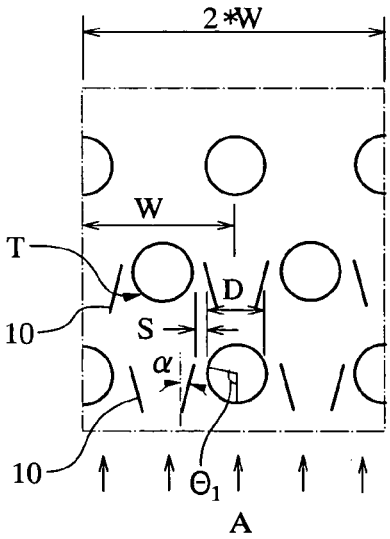
Figure 4:
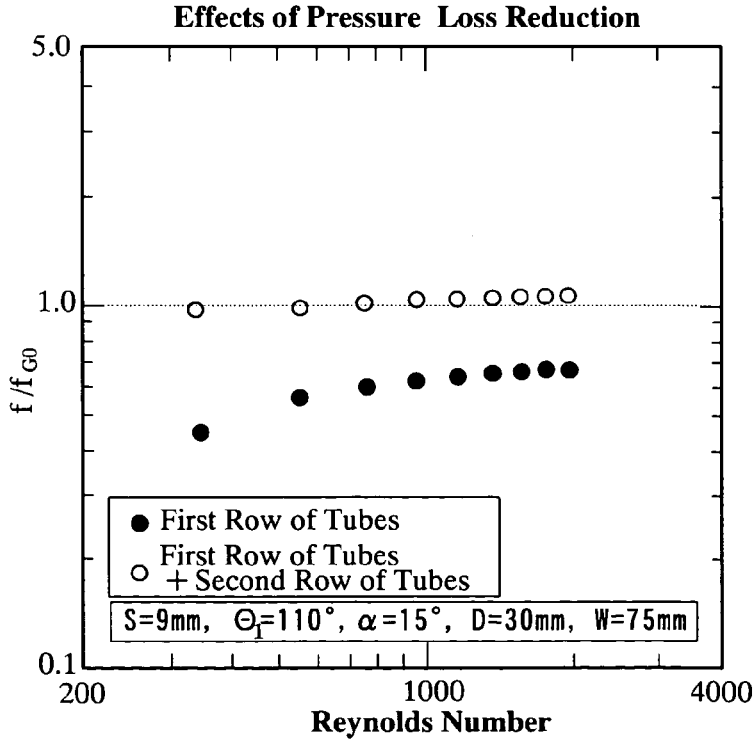

FIG. 4 is a graphic illustration showing results of experiments on augmentation of the heat transfer and reduction of the pressure loss in the heat exchanger constructed as set forth above.

The heat exchanger as used in the experiments are provided with the heat transfer tubes T located in a staggered arrangement and the dimensions of respective parts thereof are set to be as follows:

| | |
|---|---|
| Diameter of the tube T | D = 30 mm |
| Distance between the tubes T | W = 75 mm |
| Pitch of the plate fins | H = 5.6 mm |
| Altitude of the guide fin | h = 5 mm |
| Dimension of the gap 13 | S = 9 mm |
| Attack angle of the guide fin 10 | $\alpha$ = 15° |
| Angular position of the close point 14 | $\theta_1$ = 110° |

The present inventor has carried out substantive tests on effects of the heat transfer augmentation and reduction of the pressure loss with use of a first heat exchanger as shown in FIG. 4(A) and a second heat exchanger as shown in FIG. 4(B) with respect to the air flow A in a wide range of flow rate (Reynolds number=300~2000), wherein the first heat exchanger has the guide fins 10 arranged only on the front-most row of the tubes, and the second heat exchanger has the guide fins 10 arranged on the front-most row and the second row of the tubes. The results of tests on the effects of heat transfer augmentation are shown in FIG. 4(C), and the results of tests on the effects of pressure loss reduction are shown in FIG. 4(D), wherein $j/j_{GO}$ in FIG. 4(C) represents the ratio (ratio of heat transfer effect) of the transferred heat (j) as in a case of provision of the guide fin 10 relative to the transferred heat ($j_{GO}$) as in a case of lack of the guide fin 10, and wherein $f/f_{GO}$ in FIG. 4(D) represents the ratio (ratio of pressure loss) of the pressure loss (f) in a case of provision of the guide fin 10 relative to the pressure loss ($f_{GO}$) in a case of lack of the guide fin 10.

As shown in FIGS. 4(C) and 4(D), the heat exchanger with the guide fins 10 in accordance with the present embodiment exhibits generally improved heat transfer effects and pressure loss reducing effects over a wide range of flow rate. Especially, significantly improved heat transfer effects and pressure loss reducing effects have been observed in a condition of low Reynolds number. It has been found that, in a condition of Reynolds number=300~400, the ratio of heat transfer effect $j/j_{GO}$ reaches approximately 1.3 and the ratio of pressure loss reducing effect $f/f_{GO}$ is reduced to be approximately 0.45.

Figure 5:
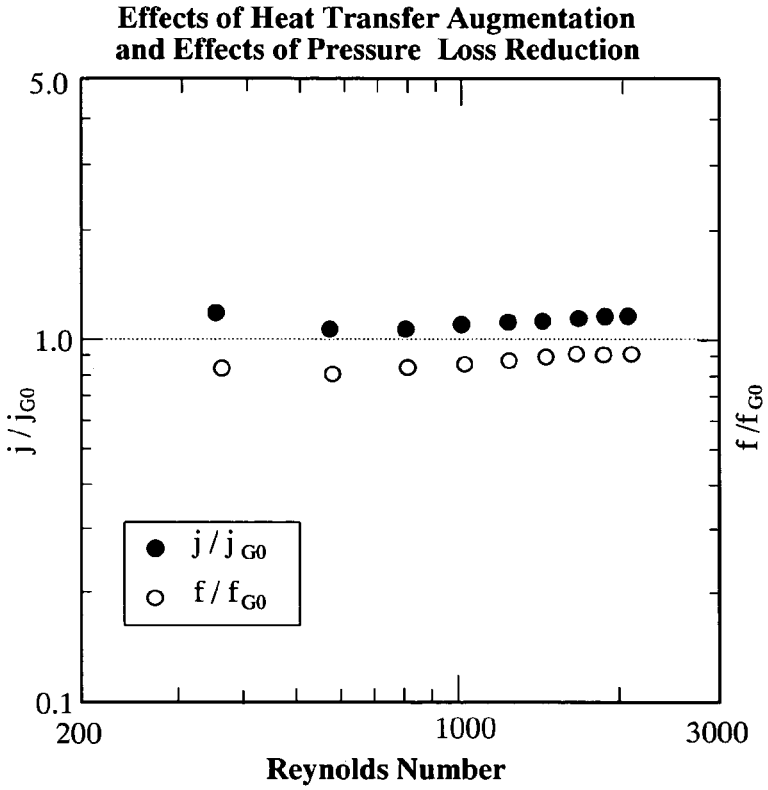
FIG. 5 includes a graphic illustration, layout drawings and table of dimension ratios which show the other experimental results on effects of augmentation of heat transfer and effects of reduction of pressure loss in the heat exchanger provided with the guide fin.
Figure 5:
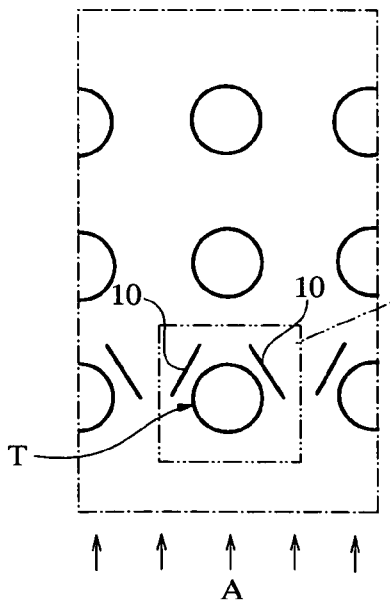
Figure 5:
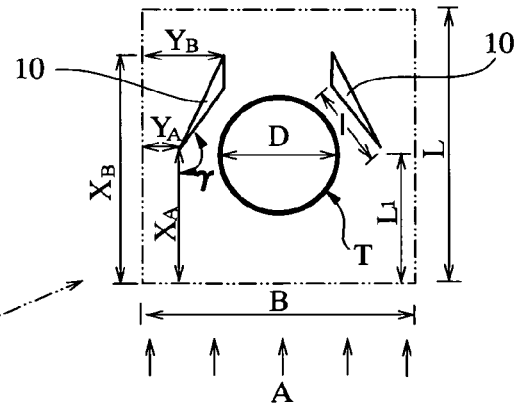
Figure 5:
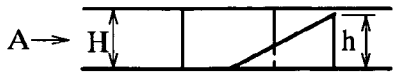
Figure 6:
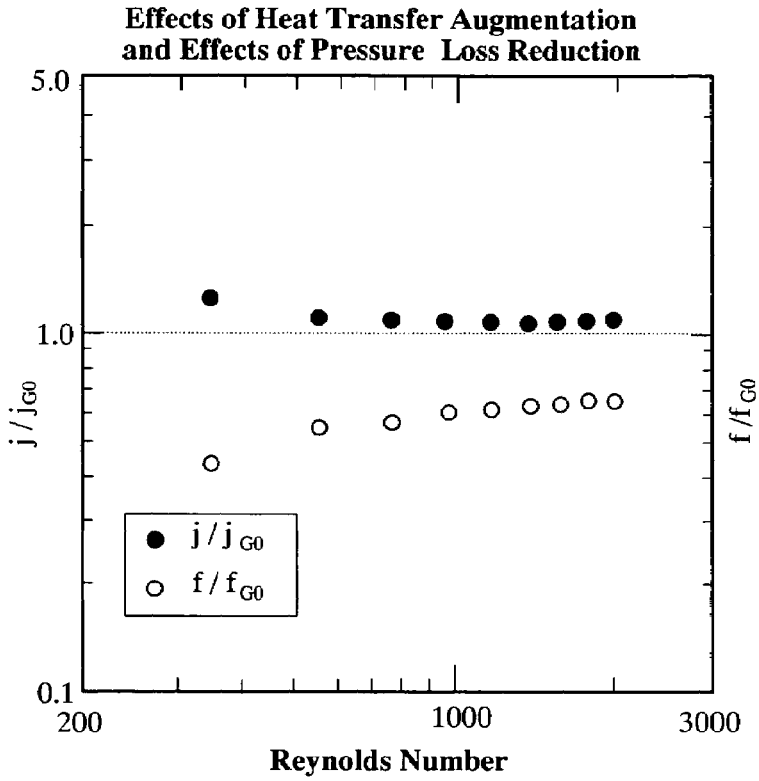
FIG. 6 is a graphic illustration, layout drawings and a table of dimension ratios which show the other experimental results on effects of augmentation of heat transfer and reduction of pressure loss in the heat exchanger provided with the guide fin, an example of the best test results obtained so far being indicated therein.
Figure 6:
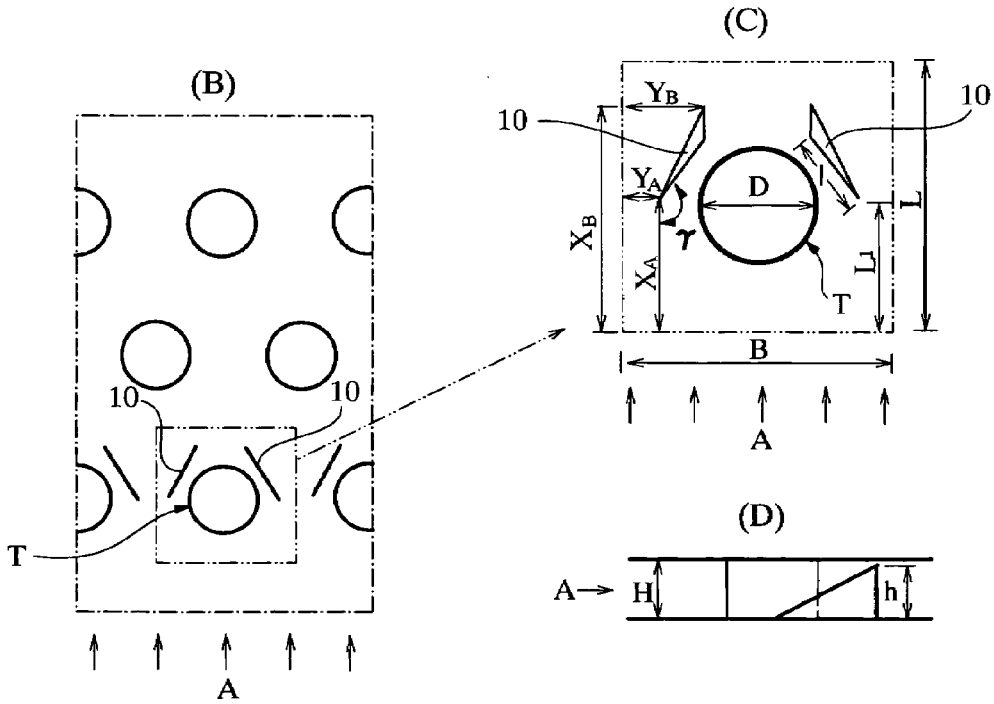
Figure 7:
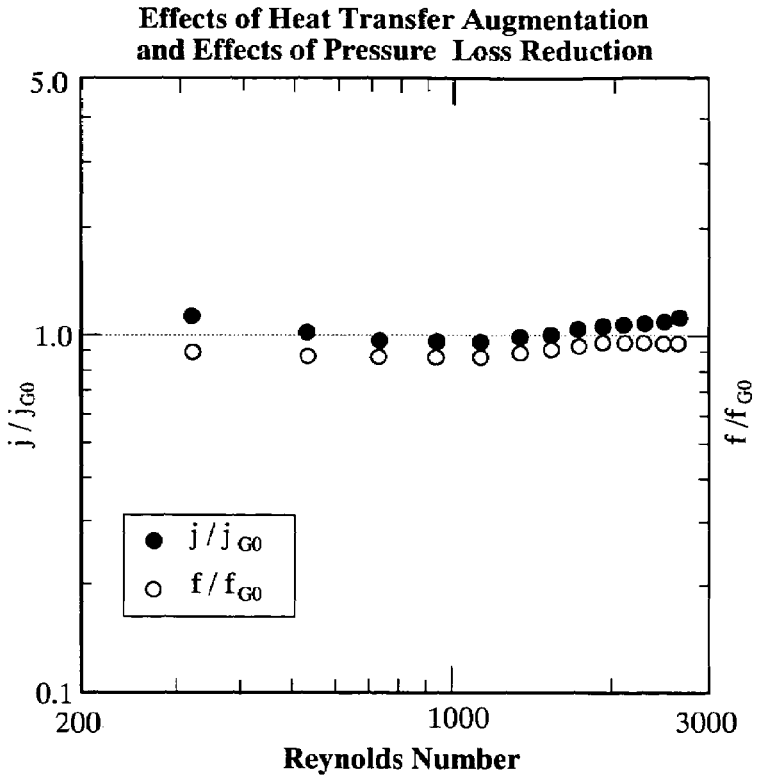
FIG. 7 includes a graphic illustration, layout drawings and a table of dimension ratios which show the other experimental results on effects of augmentation of heat transfer and reduction of pressure loss in the heat exchanger provided with the guide fin.
Figure 7:
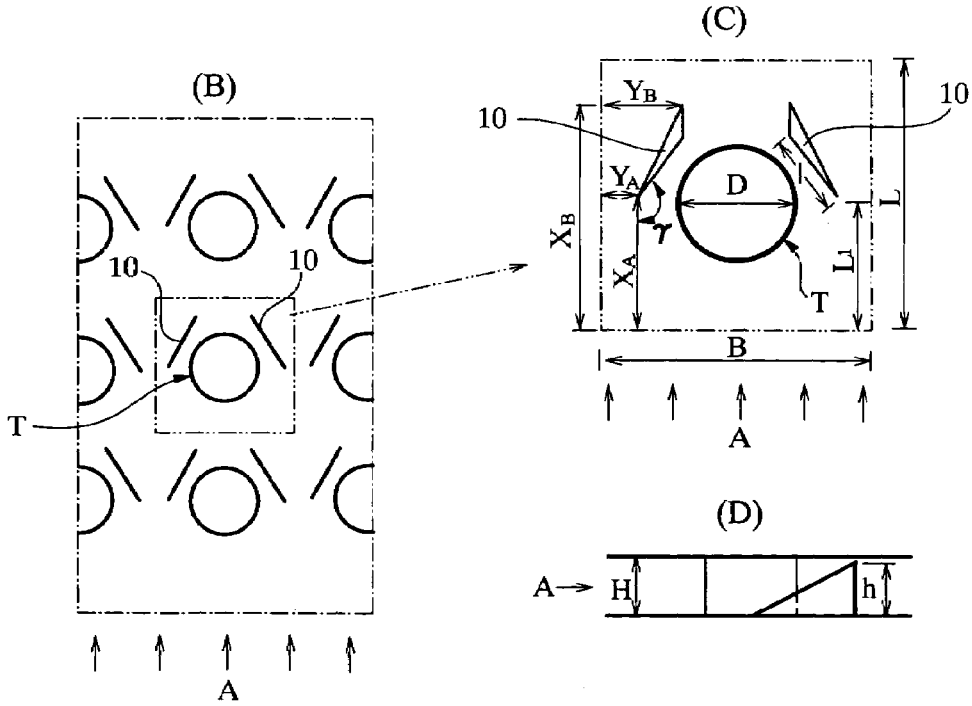

FIGS. 5 through 7 are graphic illustrations, layout drawings and tables of dimension ratios, which show the other test results on effects of augmentation of heat transfer and effects of reduction of pressure loss in the heat exchanger constructed as set forth above.

The heat exchanger, the test results of which are shown in FIG. 5, has the guide fins 10 provided only on the front-most row (upstream-most row) in an in-line arrangement (FIG. 5(B)). The heat exchanger, the test results of which are shown in FIG. 6, has the guide fins 10 provided only on the front-most row (upstream-most row) of the tubes, the tubes T being disposed in a staggered arrangement (FIG. 6(B)). Further, the heat exchanger, the test results of which are shown in FIG. 7, has the guide fins 10 provided on respective rows of the tubes, the tubes T being disposed in an in line arrangement (FIG. 7(B)). FIG. 6 exemplifies one of the most favorable results in those obtained so far.

In FIGS. 5(A), 6(A) and 7(A), there are shown ratios of dimensions of the respective parts in each of the heat exchangers as illustrated in FIGS. 5(C); (D), 6(C); (D) and 7(C); (D).

Having compared a case of provision of the guide fin 10 in the front-most row of the tubes T with a case of lack of the guide fins 10, the ratio of heat transfer effect $j/j_{GO}$ exhibits approximately 1.1~1.3 and the ratio of pressure loss reducing effect $f/f_{GO}$ exhibits approximately 0.45~0.9, as shown in the graphic diagrams of FIG. 5(A) and FIG. 6(A).

On the other hand, the ratio of heat transfer effect $j/j_{GO}$ and the ratio of pressure loss reducing effect $f/f_{GO}$ do not necessarily exhibit favorable results even if the guide fins 10 are provided for more tubes T. For instance, the ratio of heat transfer effect $j/j_{GO}$ and the ratio of pressure loss reducing effect $f/f_{GO}$ result in undesirable values on the contrary, as shown in the graphic diagram of FIG. 7(A). Therefore, the guide fins 10 are, if desired, provided only for the front-most row of the tubes T, for every two rows thereof, or for the rows spaced a few rows.

Figure 8:
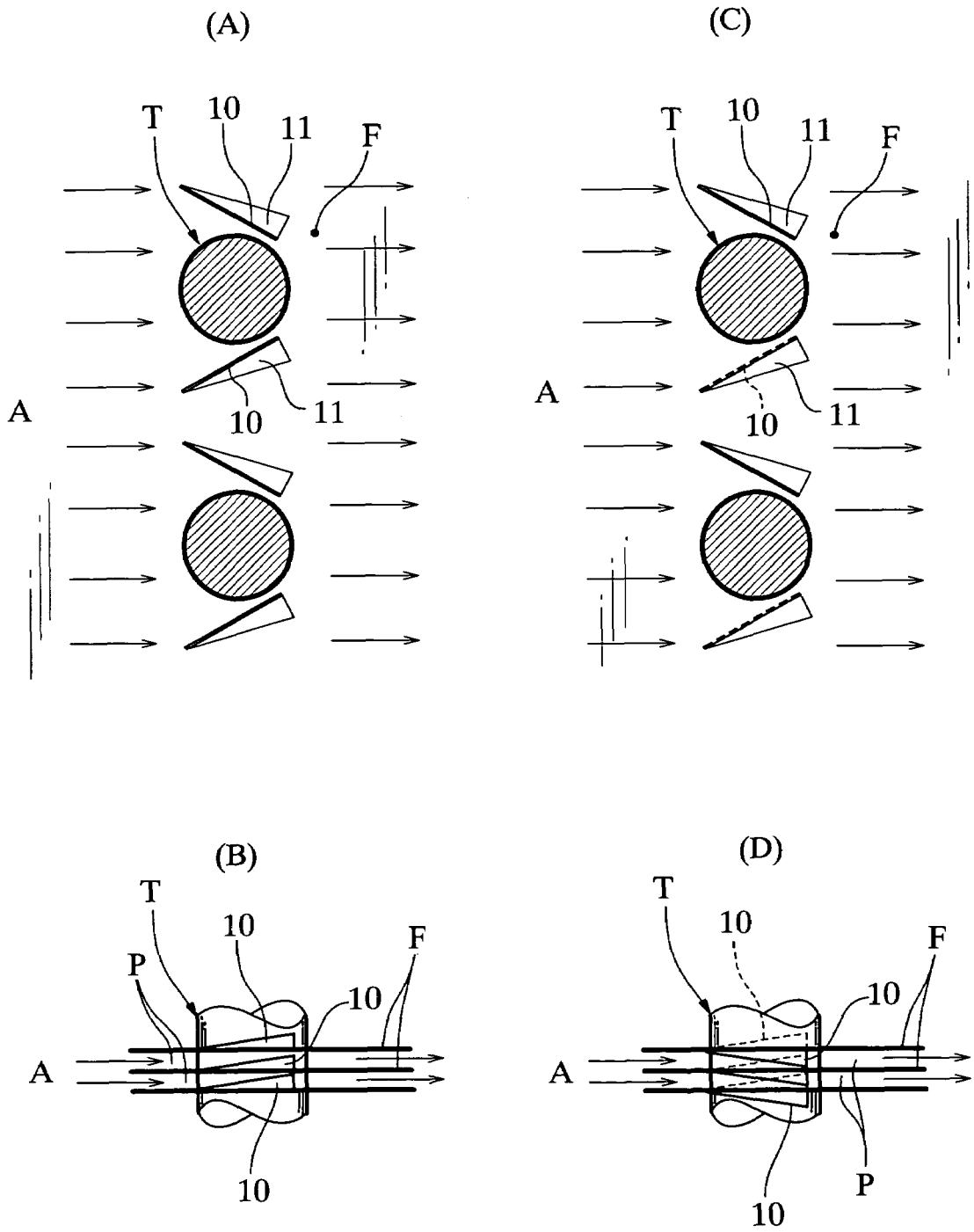
FIG. 8 is a partial cross-sectional view showing an alternative of the guide fin.
Figure 9:
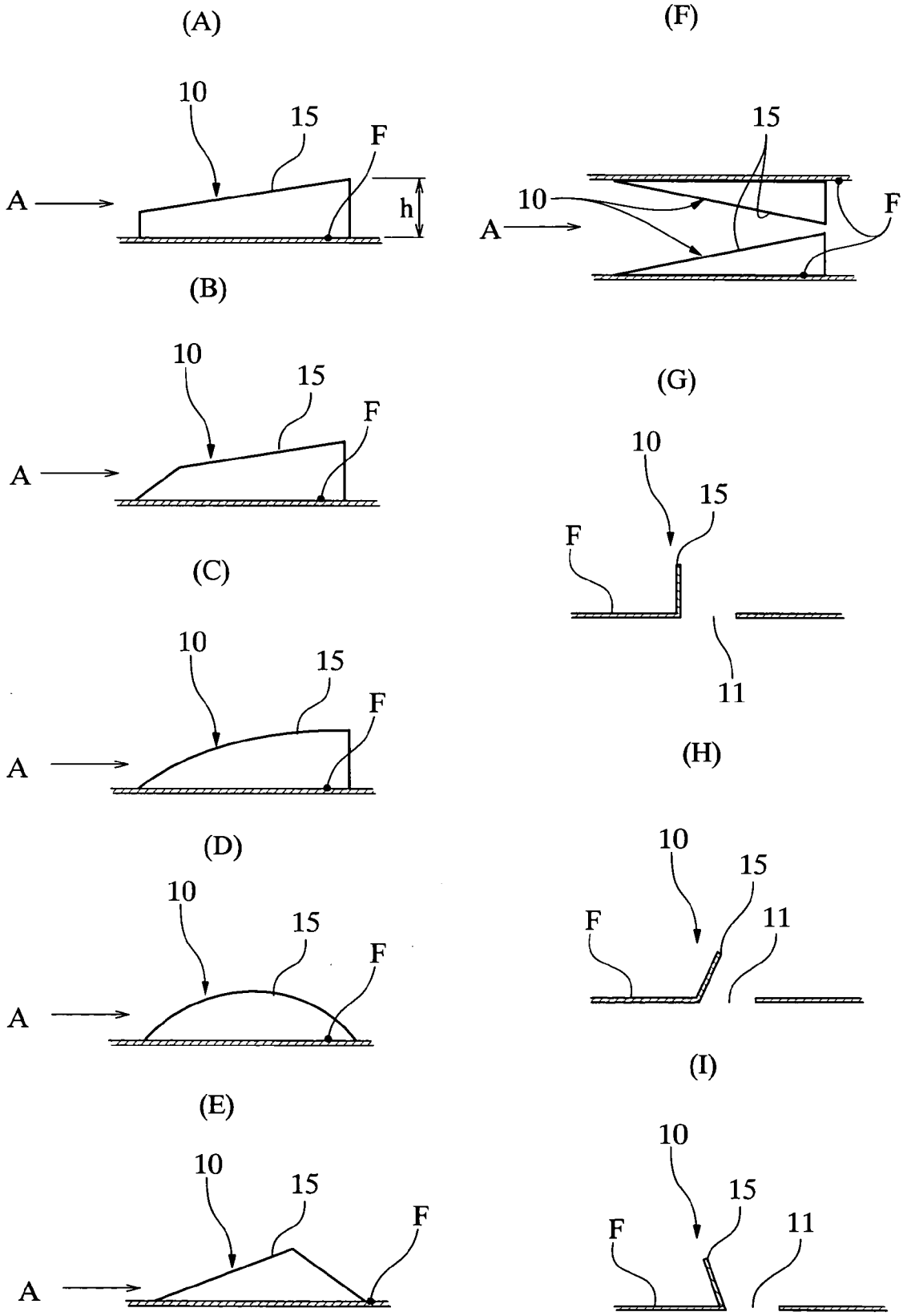
FIG. 9 is a partial cross-sectional view showing variations of the guide fin in regard to its configuration and layout.
Figure 10:
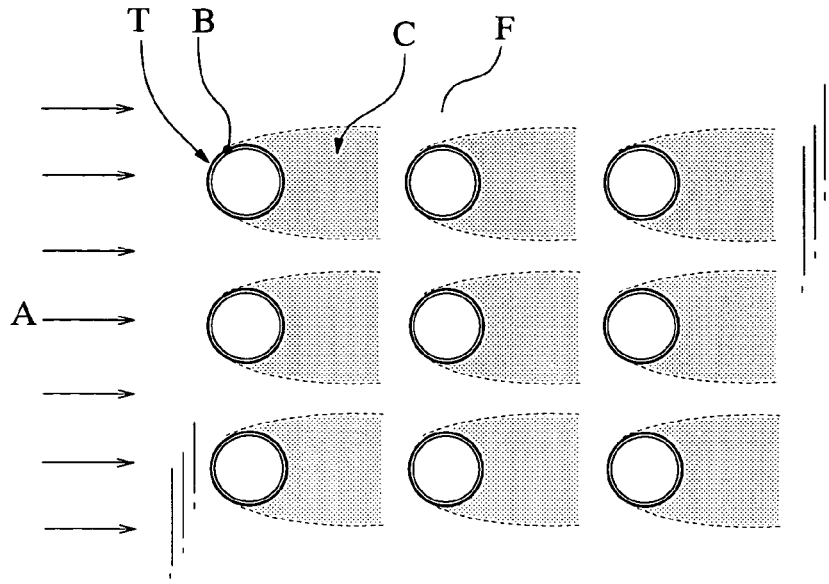
Fig. 10 Prior Art
FIG. 10 is a partial cross-sectional view showing a conventional arrangement of a plate-fin-and-tube type air-cooling heat exchanger and a property of air flow therein.
Figure 10:
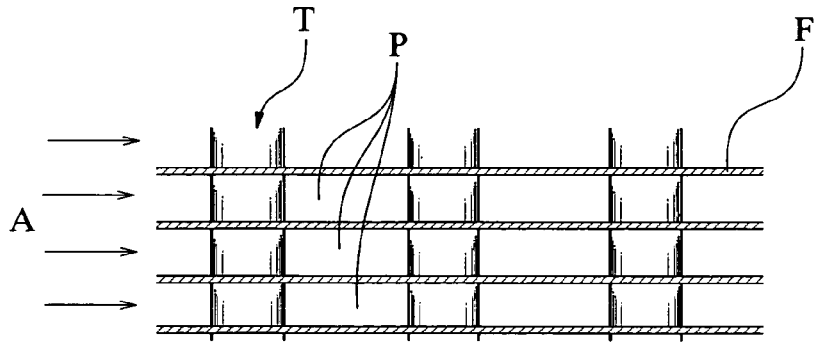
Fig. 10 Prior Art
Figure 10:
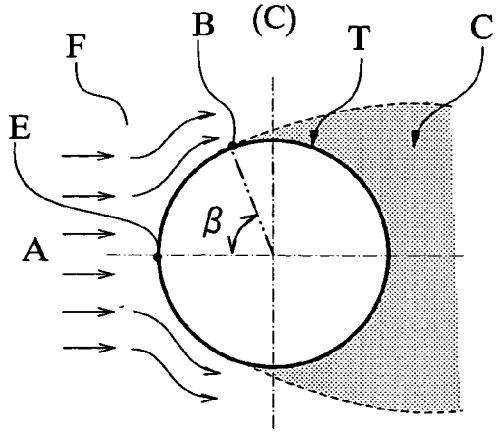
Fig. 10 Prior Art

FIGS. 8 and 9 are cross-sectional views showing alternatives of the guide fins 10.

The guide fins 10 may be cut and bent on one side of the fin F as shown in FIG. 8(A), or may be cut and bent on both sides of the fin F as shown in FIG. 8(B).

Further, the configuration of each of the guide fins 10 are not limited to the right-angled triangle, but it may have an outline, such as a form of trapezoid, rectangle, triangle or arc, so far as it includes an upper edge 15 in a form of straight line or curved line gradually increasing in its height in a direction of the air flow A, as illustrated in FIGS. 9(A)~9(E).

Furthermore, the guide fins 10 may be positioned on upper and lower fins F in a pair so as to oppose against each other, as shown in FIG. 9(F).

In addition, the guide fin 10 may be elevated from the fin F perpendicularly or inclined at a predetermined angle, as shown in FIGS. 9(G)~9(I).

Noise reduction effects obtained in the heat exchanger with the guide fins 10 as set forth above is further described hereinafter.

In general, a fin-tube type heat exchanger is provided with a fan for compulsory draft of air through the fluid passage P between the fins F A capacity of the fan is to be substantially determined in accordance with the air flow rate and the pressure loss.

A specific noise level of the fan (a maximum efficiency point) $L_{SA}$ is generally indicated by the following formula:

$$L_{SA}[\mathrm{dB}(A)]=L_A-10\times\log Q\mathrm{Pr}^2$$

wherein $L_{SA}$: Specific Noise Level [dB(A)], $L_A$: Noise Level [dB(A)],

Q: Air Flow Rate [$m^3$/min], and Pr: Pressure Loss (Total Pressure) [mmAq].

Having examined the noise reduction effects of the heat exchanger on the basis of the test results as shown in FIG. 4, the ratio of heat transfer performance $j/j_{GO}$ is approximately 1.3 (FIG. 4(C)) and the ratio of pressure loss reduction effect $f/f_{GO}$ is 0.45 (FIG. 4(D)), if the Reynolds number Re is 350. Having reviewed improvement of the heat transfer performance, the flow rate is reduced relatively to the identical heat transfer performance. Therefore, a noise reduction effect can be obtained in association with reduction of the air flow rate.

However, taking into consideration effects of the longitudinal vortex generated by the guide fin 10, noise enlargement effect due to the longitudinal vortex may be also supposed to occur. Therefore, assuming that the pressure loss is merely reduced regardless of whether the air flow rate is reduced by improvement of the heat transfer effect, it can be deemed that the pressure loss is simply reduced to 45% ($f/f_{GO}$=0.45). Therefore, provided that the flow rate Q is constant, the reduction effect of the noise level $\Delta L_A$ can be obtained on the basis of the formula for specific noise level and the above conditions, as follows:

$$\begin{aligned}\Delta L_A &= 10\times\log Pr^2 = 20\times\log Pr\\ &= 20\times\log(f/f_{GO}) = -20\times\log(f_{GO}/f)\\ &= -20\times\log(1/0.45) = -7\ \mathrm{dB}\end{aligned}$$

Similarly, in the results of tests as shown in FIG. 4, the effect of pressure loss reduction is $f/f_{GO}$=0.66 in a case of the Reynolds number Re=2000. The reduction effect of noise level $\Delta L_A$ can be similarly obtained, based on the following equation:

$$\Delta L_A=-20\times\log(1/0.66)=-3.6\ dB$$

Thus, according to a forced convection type of heat exchanger provided with the guide fins 10 arranged as set forth above, the noise level can be lowered by approximately 4 dB~7 dB over a wide range of the air flow rate (Reynolds number=300~2000), without deterioration of the heat transfer performance. In general, the fin-tube types of heat exchangers are used as air-cooled type of cooling devices for air conditioning machines or the like, and problems of fan noise are raised often. However, the load of fan can be reduced and the noise caused in operation of the fan can be considerably lowered, according to the heat exchanger with the aforementioned arrangements.

Although the present invention has been described as to specific preferred embodiments, the present invention is not limited to such embodiments, but may be modified or changed without departing from the scope of the invention as defined in the attached claims.

For instance, the heat exchanger of the aforementioned embodiment is so arranged that the heat carrier fluid at a high temperature is circulated through the heat transfer tubes T and that the cooling air flow is passed through the fluid passages P, but the kinds of fluids and the temperatures thereof are arbitrary. For example, the heat carrier fluid at a low temperature may be circulated through the heat transfer tubes T and the air flow at a high temperature may be passed through the fluid passages P.

Further, any of fluids can be used as the heat carrier fluid circulating through the tubes T and the heat carrier fluid passing through the passage P.

Furthermore, the cross-section of the tube T is not limited to the circular section, but may be a square section, elongated round section, ellipse section, or the like.

This invention can be also applied to any type of heat transfer device which comprises a linear heat transmission member in heat transferable contact with a heat carrier fluid and a plane heat transfer fin integrally formed with the heat transmission member for heat transmission between the fin and the member.

INDUSTRIAL APPLICABILITY

As described above, a heat transfer device can be provided, which can reduce the separation wake zone behind the heat transfer tube, thereby improving the heat transfer effect of the heat transfer device in the heat exchanger and so forth, and which can reduce the pressure loss of the heat transfer device, in accordance with the present invention.

Further, an air-cooled type of heat exchanger can be provided, which can decrease a load of a fan for providing compulsory draft of the heat carrier fluid, thereby reducing noise of the heat exchanger during operation of the fan, in accordance with the invention.

Furthermore, according to a separation point control method of the present invention, the position of separation point of the heat carrier fluid can be controlled with use of separation position control means having a simplified arrangement, whereby the separation wake zone behind the tube can be reduced.

The invention claimed is:

1. A heat transfer device having linear or tubular heat transfer objects which are in heat transfer contact with a heat carrier fluid, and heat transfer fins which are integrally formed with the heat transfer object for heat transmission therebetween, the heat transfer object having a circular cross-section, comprising:

a pair of guide fins positioned on both sides of said heat transfer object in the vicinity of the heat transfer object, the guide fins being configured for delaying a position of separation of the heat carrier fluid, an upstream end of the guide fin being located on an upstream side of a center of the heat transfer object, a downstream end of the guide fin being located on a downstream side of the center, each of said guide fins having an upper edge in the form of a straight line or curved line gradually increasing in height in a direction of flow of said heat carrier fluid for generating a longitudinal vortex behind the guide fin, each of the guide fins having a base on a plane of said heat transfer fin and being oriented at an attack angle α in a range from 10° to 60° relative to the direction of flow of said fluid to define a fluid passage for the heat carrier fluid between the guide fin and the heat transfer object, the passage diverging toward an upstream side of the heat transfer object and converging toward a downstream side of the heat transfer object, an altitude (h) at a highest part of the guide fin being dimensionally set to be equal to or greater than one half of an interval (Pf) of said heat transfer fins, a length (L) of said base being greater than a radius (R) of the heat transfer object, a ratio of the length (L) the base to the altitude (h) at a highest part of the guide fin being set to be in a range from 2 to 7, the downstream end of the guide fin being spaced from the heat transfer object to form a narrow gap for spouting the heat carrier fluid therethrough, so that said fluid entering an area between said heat transfer objects is accelerated between the heat transfer object and said guide fin and conducted to the rear of said heat transfer object for reducing a separation wake zone behind said heat transfer object and generating, behind the guide fin, a swirl flow deflected in accordance with an obliquity of said guide fin.

2. A heat transfer device as defined in claim 1, wherein, in relation to the radius R of said heat transfer object, a ratio of a distance R' between said downstream end and the center of said heat transfer object is set to be in a range of R'/R=1.05~2.6.

3. A heat transfer device as defined in claim 1, wherein said heat transfer object is a heat transfer tube through which a thermal medium fluid to be heated or cooled can be circulated, and said heat transfer fins are arranged in a lengthwise direction of the tube, spaced a predetermined distance from each other, so that the thermal medium fluid is cooled or heated by heat exchange between the thermal medium fluid in the tube and the heat carrier fluid flowing in close vicinity of the surfaces of the tube and the heat transfer fin; and wherein said guide fins are positioned symmetrically with respect to the tube.

4. A heat transfer device as defined in claim 1, wherein said guide fin has a triangular configuration which includes the base on the plane of said heat transfer fin.

5. An air-cooled type of heat exchanger comprising said heat transfer device as defined in claim 1, and a fan effecting compulsory draft of the heat carrier fluid, whereby noise caused in operation of the fan is diminished by reduction of pressure loss of said heat transfer device.

6. A method of controlling a position of separation in a heat transfer device which has linear or tubular heat transfer objects and heat transfer fins integrally formed with the heat transfer object for heat transmission therebetween, the heat transfer object having a circular cross-section, a heat carrier fluid being passed through a fluid passage formed between the heat transfer fins, comprising the steps of:

disposing a pair of guide fins on both sides of said heat transfer object in the vicinity of said heat transfer object to generate longitudinal vortices behind said guide fins, the guide fins being configured for delaying a position of separation of the heat carrier fluid, an upstream end of the guide fin being located on an upstream side of a center of the heat transfer object, a downstream end of the guide fin being located on a downstream side of the center, each of said guide fins having an upper edge in a form of a straight or curved line gradually increasing in its height in a direction of flow of said heat carrier fluid for generating a longitudinal vortex behind the guide fin, each of the guide fins having a base on a plane of said heat transfer fin and being oriented at an attack angle α in a range from 10° to 60° relative to a direction of flow of said fluid to define a fluid passage for the heat carrier fluid between the guide fin and the heat transfer object, the passage diverging toward an upstream side of the heat transfer object and converging toward a downstream side of the heat transfer object, an altitude (h) at a highest part of the guide fin being dimensionally set to be equal to or greater than one half of an interval (Pf) of said heat transfer fins, a length (L) of said base being greater than a radius (R) of the heat transfer object, a ratio of the length (L) the base to the altitude (h) at a highest part of the guide fin being set to be in a range from 2 to 7, the downstream end of the guide fin being spaced from the heat transfer object to form a narrow gap for spouting the heat carrier fluid therethrough, and controlling a position (β) of a separation point of said fluid with respect to the heat transfer object to be in a range of angular position equal to or greater than 90° from a stagnation point (E) on the heat transfer object by setting of an attack angle, configuration, position and dimensional proportion of the guide fin so that a swirl flow is generated behind said guide fin and that said fluid entering an area between said heat transfer object and the guide fin is accelerated therebetween and conducted to the rear of the heat transfer object.

7. A method according to claim 6, wherein in the disposing step, said guide fins are disposed in a direction of span of the heat transfer objects in symmetry and the attack angle (α) of said guide fin to a direction of flow of said heat carrier fluid is set to be a predetermined angle in a range from 10° to 60°.

8. A method according to claim 6, wherein in the controlling step, the attack angle, configuration, position and dimensional proportion of said guide fin are so set as to generate said swirl flow deviating behind the guide fin in accordance with an obliquity of said guide fin.

9. A method according to claim 6, wherein said heat carrier fluid gradually accelerates while varying in its direction, as a width of a fluid passage gradually reduces between said heat transfer object and said guide fin in accordance with an obliquity of the guide fin;

said heat carrier fluid spouts rearward through a narrow gap (13) for spouting said fluid to the rear of the heat transfer object; and a spouting flow through the gap is directed in a tangential direction of a close point (14) of the heat transfer object which opposes against the downstream end (12) of the guide fin.

10. A method according to claim 6, wherein in the controlling step, the position (β) of the separation point (B) is an angular position of the separation point with reference to said stagnation point (E) occurring at a position ranging from 100° to 135° with respect to the heat transfer object.

11. A method according to claim 6, wherein in the disposing step, said heat transfer objects are located in one of a staggered arrangement and an in-line arrangement, and said guide fins are provided only for a front-most row of said heat transfer objects.

12. A method according to claim 6, wherein in the disposing step, said heat transfer objects are located in one of a staggered arrangement and an in-line arrangement, and said guide fins are provided only for every two rows of said heat transfer objects, or for rows spaced a few rows thereof.

13. A heat transfer device having heat transfer tubes which are in heat transfer contact with a heat carrier fluid, and heat transfer fins which are integrally formed with the tubes for heat transmission therebetween, the tube having a circular cross-section, comprising:

guide fins positioned on both sides of the tube, the guide fins being configured for delaying a position of separation of the heat carrier fluid, an upstream end of the guide fins being located on an upstream side of a center of the heat transfer object, a downstream end of the guide fins being located on a downstream side of the center, each of said guide fins having a triangular configuration which includes a base on a plane of said heat transfer fin and an upper straight edge gradually increasing in height in a direction of flow of said heat carrier fluid for generating a longitudinal vortex behind the guide fin, each of the guide fins being oriented at an attach angle of a in a range from 10° to 60° relative to a direction of flow of said fluid to define a fluid passage for the heat carrier fluid between the guide fin and the tube, the passage diverging toward an upstream side of the tube and converging toward a downstream side of the tube, a downstream end of the guide fin being spaced from a tube wall of the heat transfer tube to form a narrow gap for spouting the heat carrier fluid therethrough, wherein a close point located on said tube opposing against a rear end portion of the guide fin in a direction perpendicular to said heat carrier fluid is spaced a distance (S) from the rear end portion, an altitude (h) at a highest part of the guide fin being dimensionally set to be equal to or greater than one half of an interval (Pf) of said heat transfer fins, a length (L) of said base being greater than a radius (R) of the heat transfer object, and a ratio of the length (L) f the base to the altitude (h) at a highest part of the guide fin being set to be in a range from 2 to 7.

14. A heat transfer device as defined in claim 13, wherein said guide fins are positioned symmetrically with respect to the tube.

* * * * *